US009494056B2

(12) United States Patent
Spadacini et al.

(10) Patent No.: US 9,494,056 B2
(45) Date of Patent: Nov. 15, 2016

(54) APPARATUS AND PROCESS FOR GENERATION OF ENERGY BY ORGANIC RANKINE CYCLE

(75) Inventors: Claudio Spadacini, Verbania Suna (IT); Dario Rizzi, Bisuschio (IT);
(Continued)

(73) Assignee: EXERGY S.P.A., Bologna (IT)

( * ) Notice: Subject to any disclaimer, the term of this patent is extended or adjusted under 35 U.S.C. 154(b) by 33 days.

(21) Appl. No.: 14/112,365

(22) PCT Filed: Feb. 13, 2012

(86) PCT No.: PCT/IB2012/050629
§ 371 (c)(1),
(2), (4) Date: Jan. 7, 2014

(87) PCT Pub. No.: WO2012/143799
PCT Pub. Date: Oct. 26, 2012

(65) Prior Publication Data
US 2014/0109576 A1 Apr. 24, 2014

(30) Foreign Application Priority Data
Apr. 21, 2011 (IT) ..... M12011A0684

(51) Int. Cl.
*F01K 25/08* (2006.01)
*F01D 1/06* (2006.01)
(Continued)

(52) U.S. Cl.
CPC ..... *F01K 25/08* (2013.01); *F01D 1/06* (2013.01); *F01K 7/025* (2013.01); *F01K 7/16* (2013.01); *F01K 25/10* (2013.01); *F05D 2220/31* (2013.01)

(58) Field of Classification Search
CPC ..... F01K 25/08; F01K 25/10; F01K 7/16; F01K 7/025; F01K 25/065; F01D 1/06; F05D 2210/13
(Continued)

(56) References Cited

U.S. PATENT DOCUMENTS 1,488,582 A * 4/1924 Allen ..... 415/143
3,245,512 A 4/1966 Schwiegel et al.
(Continued)

FOREIGN PATENT DOCUMENTS

DE 10008123 A1 8/2001
EP 0 353 856 A1 2/1990
(Continued)

OTHER PUBLICATIONS

Welch, P., et al., "New Turbines to Enable Efficient Geothermal Power Plants", GRC Transactions, vol. 3, 2009, pp. 765-772.
(Continued)

*Primary Examiner* — Hoang Nguyen
*Assistant Examiner* — Kelsey Stanek
(74) *Attorney, Agent, or Firm* — Pearne & Gordon LLP

(57) ABSTRACT

An apparatus for generation of energy through organic Rankine cycle comprises a heat exchanger (3) to exchange heat between a high temperature source and an organic working fluid, so as to heat and evaporate said working fluid, an expansion turbine (4) of the radial-outflow type, fed with the vaporized working fluid outflowing from the heat exchanger (3), to make a conversion of the thermal energy present in the working fluid into mechanical energy according to a Rankine cycle, a condenser (6) where the working fluid outflowing from the turbine (4) is condensed and sent to a pump (2) and then fed to the heat exchanger (3).

11 Claims, 4 Drawing Sheets

(75) Inventors: Alessandro Barbato, Dairago (IT); Lorenzo Centemeri, Milan (IT)

(51) Int. Cl.
*F01K 7/02* (2006.01)
*F01K 25/10* (2006.01)
*F01K 7/16* (2006.01)

(58) Field of Classification Search
USPC ..... 60/651, 671, 692; 415/84, 106, 173.1, 415/173.5
See application file for complete search history.

(56) References Cited

U.S. PATENT DOCUMENTS

| | | | | |
|---|---|---|---|---|
| 3,314,647 | A | 4/1967 | Pavlecka | |
| 4,458,493 | A | 7/1984 | Amir et al. | |
| 4,661,042 | A | 4/1987 | Goloff | |
| 4,876,855 | A | 10/1989 | Yogev et al. | |
| 5,071,312 | A | 12/1991 | Kirby | |
| 7,244,095 | B2 * | 7/2007 | Hays | F01D 1/06 415/106 |
| 2008/0247885 | A1 * | 10/2008 | Hagen | F02C 7/1435 417/244 |
| 2009/0249786 | A1 * | 10/2009 | Garrett et al. | 60/612 |
| 2010/0122534 | A1 * | 5/2010 | Ast et al. | 60/651 |
| 2010/0194111 | A1 * | 8/2010 | Van Den Bossche | F01K 3/247 290/2 |
| 2011/0072819 | A1 * | 3/2011 | Silva | F01K 23/065 60/651 |
| 2011/0162366 | A1 | 7/2011 | Schwiegel et al. | |
| 2011/0283702 | A1 * | 11/2011 | Huber | F01D 15/10 60/651 |
| 2012/0006024 | A1 * | 1/2012 | Hays | F01K 25/065 60/651 |
| 2012/0096830 | A1 | 4/2012 | Manoharan | |

FOREIGN PATENT DOCUMENTS

| | | | |
|---|---|---|---|
| EP | 1764487 | A1 | 3/2007 |
| EP | 2 080 876 | A2 | 7/2009 |
| GB | 280657 | A | 11/1927 |
| GB | 310037 | A | 2/1930 |
| GB | 372520 | A | 5/1932 |
| GB | 497922 | A | 12/1938 |
| WO | 2010/106570 | A1 | 9/2010 |
| WO | 2011/007366 | A1 | 1/2011 |
| WO | WO 2011007366 | A1 * | 1/2011 |
| WO | 2011030285 | A1 | 3/2011 |

OTHER PUBLICATIONS

Welch, P., et al., "Performance of New Turbines for Geothermal Power Plants", GRC Transactions, vol. 34, 2010, pp. 1091-1096.

Macchi, E., "Design Criteria for Turbines Operating With Fluids Having a Low Speed of Sound", von Karman Institute for Fluid Dynamics, Lecture Series 100, Closed-Cycle Gas Turbines, May 9-13, 1977, 64 pages.

Martin, C., et al., "Study of Advanced Radial Outflow Turbine for Solar Steam Rankine Engines", Energy Technology, Inc., Cleveland, Ohio, prepared for National Aeronautics and Space Administration, Dec. 1979, 73 pages.

Sandrolini, S., et al., "Macchine 2, Le Turbomacchine Motrici E Operatrici", Pitagora Editrice S.R.L., Bologna, Italy, 1996, pp. 155-170.

Bruni, G., "Third Party Observations Against European Patent Application No. EP 12707925.9", Issued by the European Patent Office on Aug. 8, 2014, 13 pages.

Bruni, Giovanni, "Third Party Observations Against Patent Application No. EP12707925.9", Received at the European Patent Office on Apr. 22, 2014, 16 pages.

G. Angelino, P. Ferrari, G. Giglioli and E. Macchi, "Combined Thermal Engine-Heat Pump Systems for Low-Temperature Heat Generation", Proceedings of the Institution of Mechanical Engineers, vol. 190, 1976, pp. 255-265 and D79-D81.

Levin, R.E., "Heat Engineering", Office on Iron Industry and Non-Ferrous Metallurgy, 1951, pp. 236-237, with explanation of relevance.

Drescher, U, et al., "Fluid Selection for the Organic Rankine Cycle (ORC) in Biomass Power and Heat Plants", Applied Thermal Engineering, vol. 27, No. 1, Jan. 1, 2007, pp. 223-228 (XP055132651).

3M "Stable, Efficient, Sustainable, Environmentally Sustainable Working Fluids for Organic Rankine Cycle (ORC) Systems", Apr. 1, 2009, 4 pages, (XP 055132617).

* cited by examiner

APPARATUS AND PROCESS FOR GENERATION OF ENERGY BY ORGANIC RANKINE CYCLE

TECHNICAL FIELD

The present invention relates to an apparatus and process for energy generation by organic Rankine cycle.

Apparatuses based on a thermodynamic Rankine cycle (ORC—Organic Rankine Cycle) are known which carry out conversion of thermal energy into mechanical and/or electric energy in a simple and reliable manner. In these apparatus working fluids of the organic type (of high or medium molecular weight) are preferably used in place of the traditional water/vapour system, because an organic fluid is able to convert heat sources at relatively low temperatures, generally between 100° C. and 300° C., but also at higher temperatures, in a more efficient manner. The ORC conversion systems therefore have recently found increasingly wider applications in different sectors, such as in the geothermic field, in the industrial energy recovery, in apparatus for energy generation from biomasses and concentrated solar power (CSP), in regasifiers, etc.

BACKGROUND ART

An apparatus of known type for conversion of thermal energy by an organic Rankine cycle (ORC) generally comprises: at least one heat exchanger exchanging heat between a high-temperature source and a working fluid, so as to heat, evaporate (and possibly superheat) the working fluid; at least one turbine fed by the vaporised working fluid outflowing from the heat exchanger so as to carry out conversion of the thermal energy present in the working fluid into mechanical energy according to a Rankine cycle; at least one generator operatively connected to the turbine, in which the mechanical energy produced by the turbine is converted into electric energy; at least one condenser where the working fluid coming out of the turbine is condensed and sent to at least one pump; from the pump the working fluid is fed to the heat exchanger.

Turbines of known type for high-molecular-weight gas and vapour expansion are for example described in public documents U.S. Pat. No. 4,458,493 and WO 2010/106570. The turbine disclosed in U.S. Pat. No. 4,458,493 is of the multistage type where a first axial stage is followed by a radial centripetal stage. The turbine disclosed in document WO 2010/106570 on the contrary is of the axial type and comprises a box with a peripheral volute for transit of a working fluid from an inlet to an outlet, a first stator and possible other stators, a turbine shaft rotating about an axis and carrying a first rotor and possible other rotors. A tubular element extends in cantilevered fashion from the box and is coaxial with the turbine shaft. A supporting unit is positioned between the tubular element and the turbine shaft and is extractable all together from the tubular element, except for the shaft.

More generally, the types of known expansion boxes presently in use for thermodynamic ORC cycles are of the axial, one-stage and multi-stage type and of the radial one-stage and multi-stage centripetal or inflow type.

Document WO 2011/007366 shows a turbine used in the field of ORC thermodynamic cycles for generation of energy comprising three radial stages disposed axially after each other.

Document EP 2 080 876 shows a turbomachine, in particular a multi-stage turbocompressor comprising two turbines, one of which is a radial-inflow turbine, and two compressors.

Document U.S. Pat. No. 1,488,582 illustrates a turbine provided with one high-pressure portion and one low-pressure portion in which the fluid flow is gradually deviated from an axial direction to a radial direction.

Document US 2010/0122534 shows a closed or endless circuit system for energy recovery comprising a radial-inflow turbine.

DISCLOSURE OF THE INVENTION

Within this scope, the Applicant has felt the necessity to:

- increase the efficiency of the energy conversion taking place inside said turbines, relative to the turbines presently in use in ORC apparatus;
- reduce the structural complexity and increase reliability of the turbines, relative to the turbines presently in use in ORC apparatus.

More particularly, the Applicant has felt the necessity to reduce losses due to leakage and ventilation of the working fluid as well as thermal losses, in order to improve the overall efficiency of the turbine and the energy conversion process in the turbine and, more generally, in the ORC apparatus.

The Applicant has found that the above listed aims can be achieved using radial centrifugal or outflow expansion turbines within the sector of apparatus and processes for energy generation through organic Rankine cycle (ORC).

More particularly, the invention relates to an apparatus for energy generation through an organic Rankine cycle comprising: an organic working fluid of high molecular weight; at least one heat exchanger to exchange heat between a high temperature source and the working fluid, so as to heat and evaporate said working fluid; at least one expansion turbine fed with the vaporised working fluid outflowing from the heat exchanger, to carry out conversion of the thermal energy present in the working fluid into mechanical energy according to a Rankine cycle; at least one condenser where the working fluid outflowing from said at least one turbine is condensed and sent to at least one pump; the working fluid being then fed to said at least one heat exchanger; characterised in that the expansion turbine is of the radial-outflow type.

The organic working fluid of high molecular weight can be selected from the group comprising hydrocarbons, ketones, siloxanes or fluorinated materials (the perfluorinated materials being included) and usually has a molecular weight included between 150 and 500 g/mol. Preferably, this organic working fluid is perfluoro-2-methylpentane (having the further advantages of not being toxic and not being inflammable), perfluoro 1,3 dimethylcyclohexane, hesamethyldisiloxane or octamethyltrisiloxane.

In another aspect, the present invention relates to a process for energy generation through the organic Rankine cycle, comprising: i) feeding an organic working fluid through at least one heat exchanger to exchange heat between a high temperature source and said working fluid, so as to heat and evaporate said working fluid; ii) feeding the vaporised organic working fluid outflowing from the heat exchanger to at least one expansion turbine to carry out conversion of the thermal energy present in the working fluid into mechanical energy according to a Rankine cycle; iii) feeding the organic working fluid outflowing from said at least one expansion turbine to at least one condenser where the working fluid is condensed; iv) sending the organic working fluid outflowing from the condenser to said at least one heat exchanger; characterised in that in step ii) the way followed by the working fluid from an inlet to an outlet of the expansion turbine is at least partly a radial-outflow way.

The Applicant has ascertained that the radial-outflow turbine is the most appropriate machine for the application in reference, i.e. for expansion of the working fluid of high molecular weight in an ORC cycle, because:

- expansions in ORC cycles are characterised by low enthalpic changes and the radial-outflow turbine being the object of the invention is suitable for applications with low enthalpic changes because it carries out lower works relative to the axial and/or radial inflow machines, the peripheral speed and reaction degree being the same;
- expansions in ORC cycles are characterised by low rotation speeds and low peripheral speeds of the rotor, due to the low enthalpic changes characterising the mentioned cycles, moderate temperatures or at all events not as high as in gas turbines for example, and the radial-outflow turbine is well adapted for situations with low mechanical and thermal stresses;
- because Rankine cycles in general and ORC cycles in particular are characterised by high volume-expansion ratios, the radial-outflow turbine optimises the heights of the machine blades, and in particular of the first stage, due to the fact that the wheel diameter grows in the flow direction; therefore total and not choked admission is almost always possible;
- since the construction shape of the radial-outflow turbine enables several expansion stages to be obtained on a single disc, losses due to secondary flows and leakage can be reduced and at the same time more reduced costs can be reached;
- in addition, the expansion turbine in the radial-outflow configuration makes it superfluous to twist the blades on the last expansion stage, thus simplifying the machine construction.

According to a preferred embodiment, the expansion turbine comprises a fixed box having an axial inlet and a radially peripheral outlet, only one rotor disc mounted in the box and rotating around a rotation axis "X-X", at least one first series of rotor blades mounted on a front face of the rotor disc and disposed around the rotation axis "X-X", and at least one first series of stator blades mounted on the box, facing the rotor disc and disposed around the rotation axis "X-X".

Preferably, the expansion turbine comprises at least one second series of rotor blades disposed at a radially external position to the first series of rotor blades and at least one second series of stator blades disposed at a radially external position to the first series of stator blades.

The radial-outflow turbine being the object of the invention needs only one disc also for multi-stage machines, unlike axial machines, and therefore offer less losses due to ventilation and more reduced costs. Due to the aforesaid compactness, very reduced plays can be maintained, which results in reduced leakage and therefore smaller losses due to escape. Thermal losses too are smaller.

In addition, the blades of the radial centrifugal turbine have not to be twisted and this involves lower production costs for said blades and the turbine as a whole.

According to a preferred embodiment, the radial-outflow expansion turbine comprises a baffle fixedly mounted on the box at the axial inlet and adapted to radially deviate the axial flow towards the first series of stator blades.

Preferably, the baffle has a convex surface facing the inflow.

Preferably, the baffle carries the first series of stator blades at a radially peripheral portion thereof.

In addition to limiting the fluid-dynamic losses at the first stator inlet, the baffle aims at preventing the fluid at higher pressure from hitting the moving parts. This expedient further reduces losses by friction on the rotor disc and allows greater flexibility when conditions different from the design conditions occur.

Preferably, the front face of the rotor disc and the face of the box carrying the stator blades diverge from each other on moving away from the rotation axis "X-X".

Preferably, the expansion turbine comprises a diffuser placed at a radially external position relative to the stator or rotor blades.

The radial turbine in the outflow configuration facilitates accomplishment of the diffuser enabling recovery of the kinetic energy at the discharge and therefore more overall efficiency of the machine.

In an alternative embodiment, the expansion turbine comprises at least one radial-outflow stage and at least one axial stage preferably disposed on a radially external perimeter of the rotor disc.

Further features and advantages will become more apparent from the detailed description of a preferred but not exclusive embodiment of an apparatus and a process for generation of energy through organic Rankine cycle according to the present invention.

BRIEF DESCRIPTION OF THE DRAWINGS

The detailed description of these configurations will be set out hereinafter with reference to the accompanying drawings, given by way of non-limiting example, in which.

DETAILED DESCRIPTION OF THE PREFERRED EMBODIMENTS OF THE INVENTION

Figure 1:
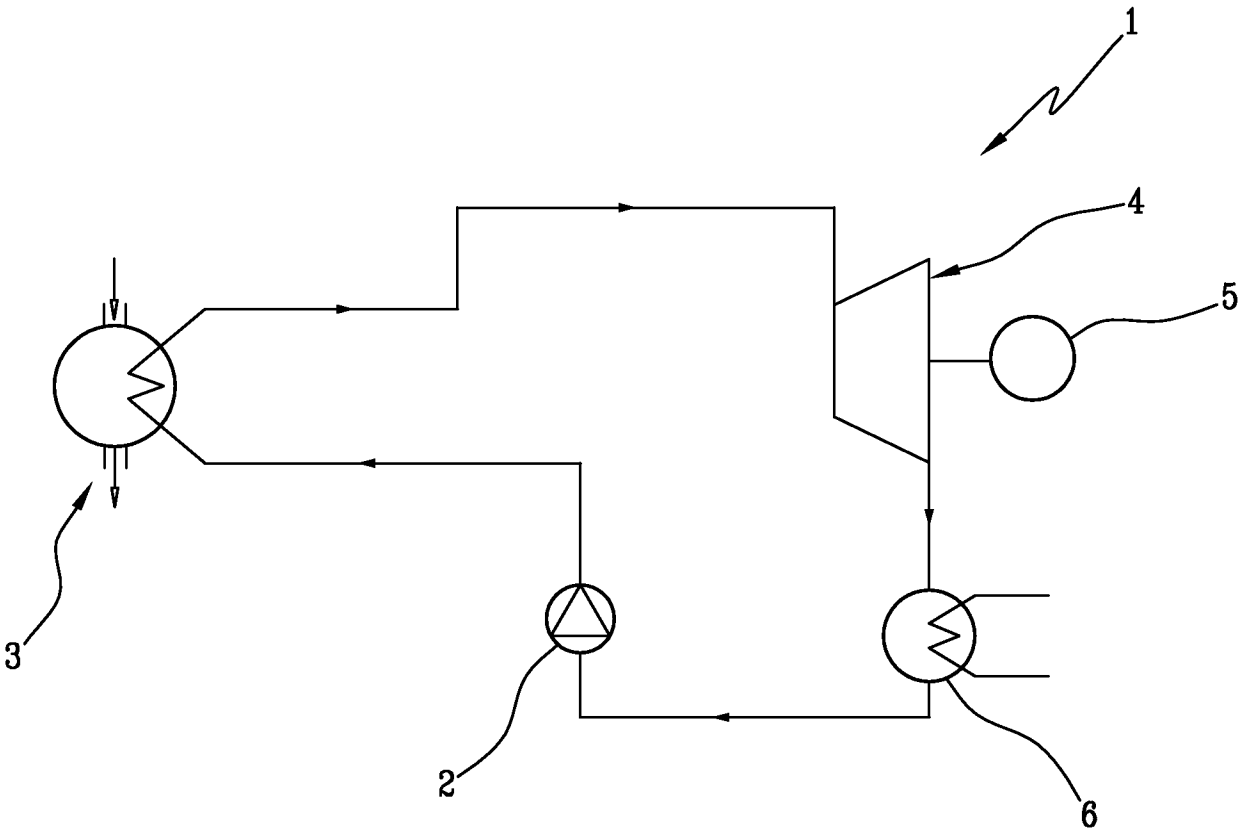
FIG. 1 diagrammatically shows the base configuration of an apparatus for energy generation through organic Rankine cycle according to the present invention.

With reference to the drawings, an apparatus for energy generation through organic Rankine cycle (ORC) according to the present invention has been generally identified with reference numeral 1.

Apparatus 1 comprises an endless circuit in which an organic working fluid of high or medium molecular weight flows. This fluid can be selected from the group comprising hydrocarbons, ketones, fluorocarbons and siloxanes. Preferably this fluid is a perfluorinated fluid with a molecular weight included between 150 and 500 g/mol.

FIG. 1 shows the circuit of the Rankine cycle in its base configuration and contemplates: a pump 2, a heat exchanger or thermal exchanger 3, an expansion turbine 4 connected to an electric generator 5, a condenser 6.

Pump 2 admits the organic working fluid from condenser 6 into the heat exchanger 3. In the heat exchanger 3 the fluid is heated, evaporated and then fed in the vapour phase to turbine 4, where conversion of the thermal energy present in the working fluid into mechanical energy and then into electrical energy through generator 5 is carried out. Downstream of turbine 4, in condenser 6, the working fluid is condensed and sent again to the heat exchanger through pump 2.

The pump 2, heat exchanger 3, generator 5 and condenser 6 will be not further described herein as they are of known type.

Advantageously, the expansion turbine 4 is of the one-stage or multistage radial-outflow type, i.e. it consists of one or more radial-outflow expansion stages, or at least one radial-outflow stage and of at least one axial stage. In other words, the working fluid flow enters turbine 4 along an axial direction in a radially more internal region of turbine 4 and flows out in an expanded condition along a radial or axial direction in a radially more external region of the turbine 4 itself. During the way between entry and exit the flow moves away, while expanding, from the rotation axis "X-X" of the turbine 4.

Figure 2:
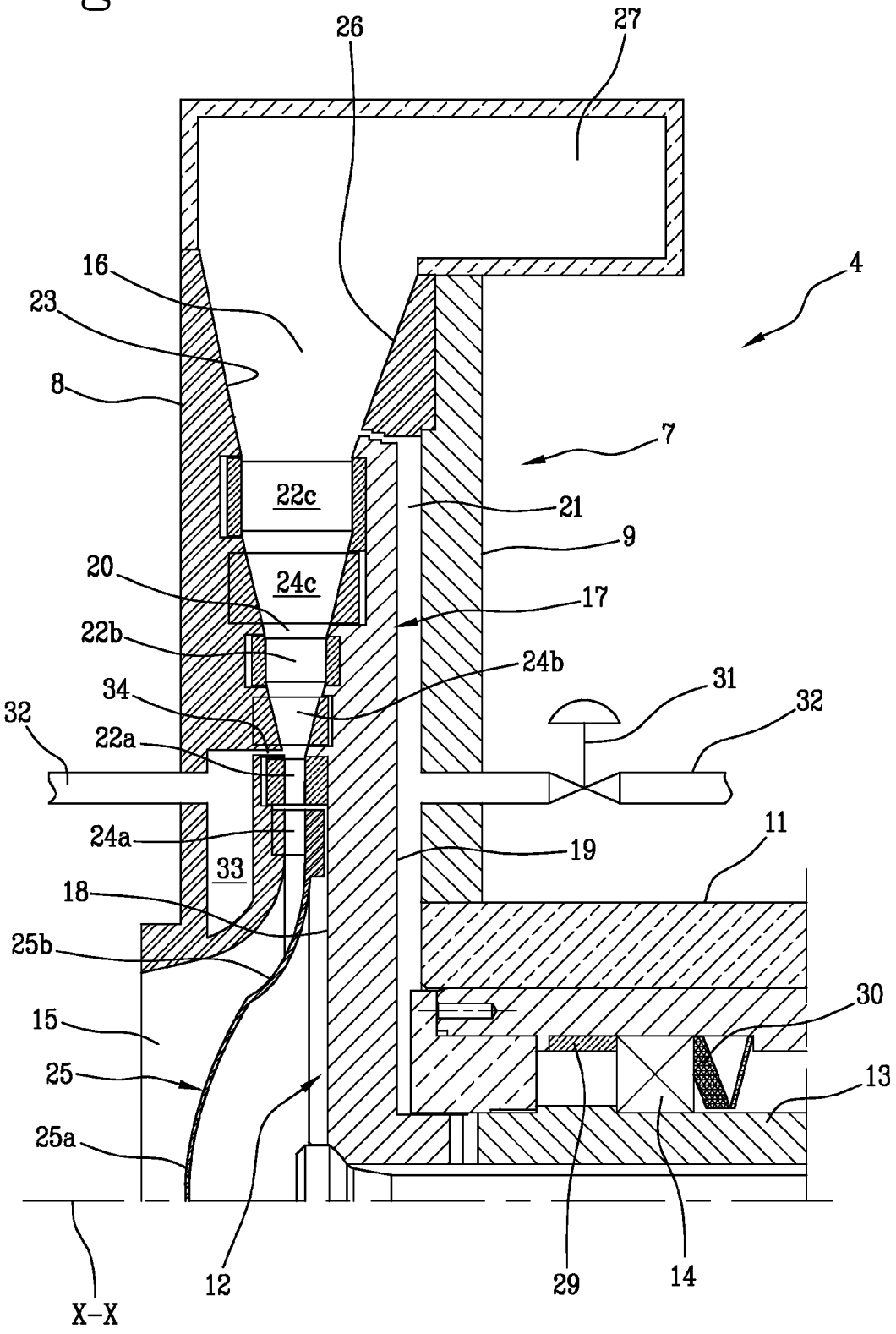
FIG. 2 is a side section view of a turbine belonging to the apparatus in FIG. 1.
Figure 3:
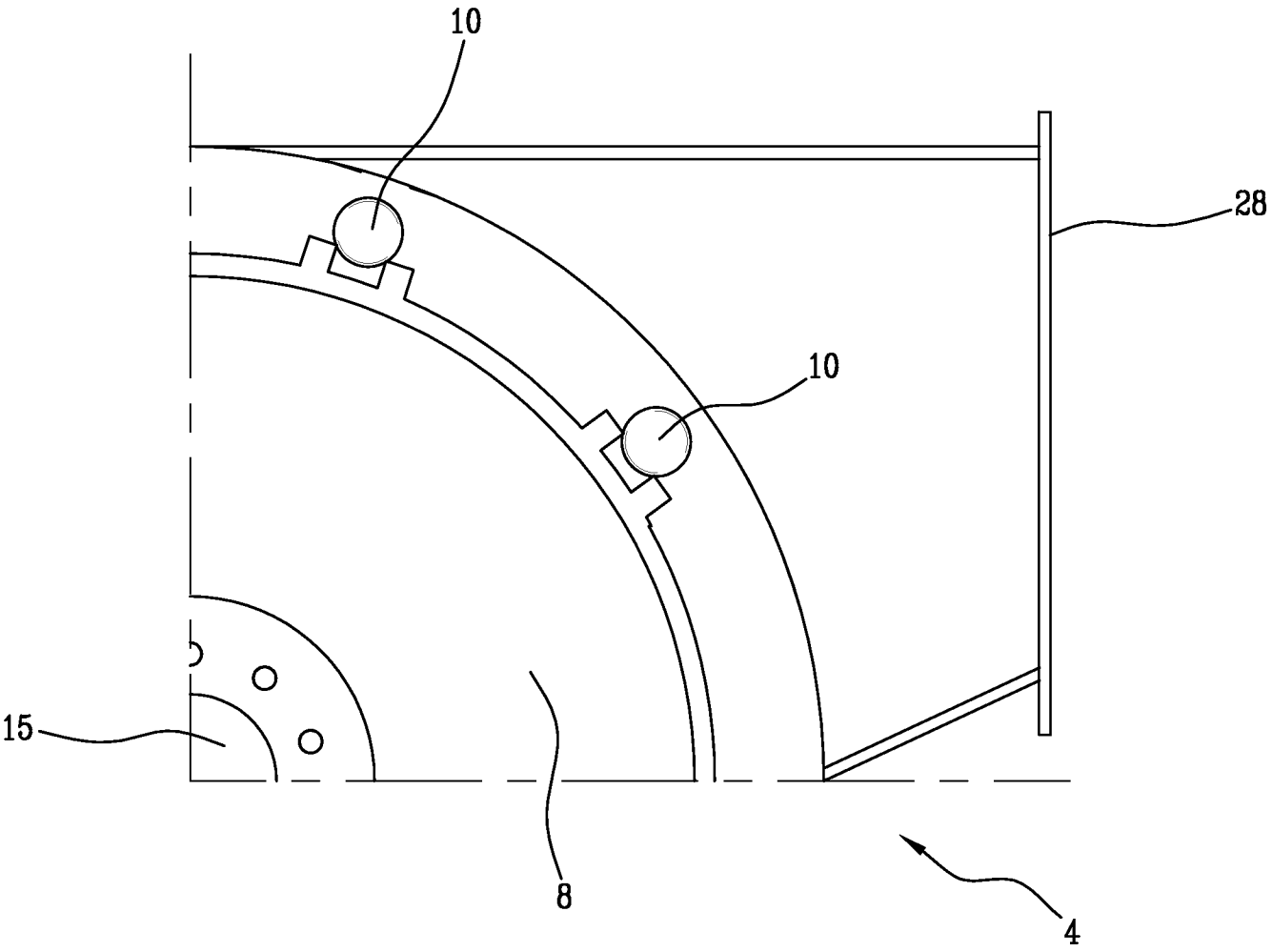
FIG. 3 is a partial front section view of the turbine in FIG. 2.

A preferred but non-limiting embodiment of the radial-outflow turbine is shown in FIGS. 2 and 3. This turbine 4 comprises a fixed box 7 formed with a front box half of circular shape and a rear box half 9 joined together by bolts 10 (FIG. 3). A sleeve 11 emerges in cantilevered fashion from the rear box half 9.

In the inner volume delimited by the front 8 and rear 9 box halves a rotor is housed 12 which is rigidly constrained to a shaft 13 in turn rotatably supported in sleeve 11 by means of bearings 14 so that it is free to rotate around a rotation axis "X-X".

Formed in the front box half 8, at the rotation axis "X-X", is an axial inlet 15 and, at a peripheral radial portion of box 7, a radially peripheral outlet external to diffuser 16 is formed.

Rotor 12 comprises a single rotor disc 17 fastened to shaft 13, perpendicular to the rotation axis "X-X" and having a front face 18 turned towards the front box half 8 and a rear face 19 turned towards the rear box half 9. Delimited between the front face 18 of the rotor disc 17 and the front box half 8 is a passage volume 20 for the organic working fluid. A compensation chamber 21 is confined between the rear face 19 of the rotor disc 17 and the rear box half 9.

The front face 18 of the rotor disc 17 carries three series of rotor blades 22*a*, 22*b*, 22*c*. Each series comprises a plurality of flat rotor blades disposed around the rotation disc "X-X". The rotor blades of the second series 22*b* are disposed at a radially external position to the rotor blades of the first series 22*a* and the rotor blades of the third series 22*c* are disposed at a position radially external to the rotor blades of the second series 22*b*. Three series of stator blades 24*a*, 24*b*, 24*c* are mounted on the inner face 23 turned towards rotor 17 of the front box half 8. Each series comprises a plurality of flat stator blades disposed around the rotation axis "X-X". The stator blades of the first series 24*a* are disposed at a position radially internal to the rotor blades of the first series 22*a*. The stator blades of the second series 24*b* are disposed at a position radially external to the rotor blades of the first series 22*a* and at a position radially internal to the rotor blades of the second series 22*b*. The stator blades of the third series 24*c* are disposed at a position radially external to the rotor blades of the second series 22*b* and at a position radially internal to the rotor blades of the third series 22*c*. Turbine 4 therefore has three stages.

Inside turbine 1, the working fluid flow entering the axial inlet 15 is deviated by a baffle 25 having a convex circular shape, which is fixedly mounted on box 7 in front of rotor 17 and is disposed coaxial with the rotation axis "X-X", the convexity thereof facing the axial inlet 15 and the inflowing flow. Baffle 25 radially extends starting from the rotation axis "X-X" until the first series of stator blades 24*a*. The stator blades of the first series 24*a* are integrated into the peripheral portion of baffle 25 and have an end mounted on the inner face 23 of the front box half 8. In greater detail, baffle 25 is defined by a convex thin plate having a radial symmetry with a convex/concave central portion 25*a* the convexity of which faces the front box half 8 and the axial inlet 15 and a radially outermost portion 25*b* that is annular and concave/convex and the concavity of which faces the front box half 8. The front box half 8 and the radially outermost portion 25*b* of baffle 25 confine a diverging duct guiding the working fluid to the first stage (rotor blades of the first series 22*a* and stator blades of the first series 24*a*) of turbine 4.

The front face 18 of the rotor disc 8 and face 23 of the front box half 8 carrying the stator blades 24*a*, 24*b*, 24*c* diverge from each other on moving away from the rotation axis (X-X), starting from said first stage, and the radially outermost blades have a blade height greater than that of the radially innermost blades.

Turbine 4 further comprises a diffuser 26 for recovery of the kinetic energy, which is placed at a radially external position relative to the third stage (rotor blades of the third series 22*c* and stator blades of the third series 24*c*) and is defined by the front face 18 of the rotor disc 8 and the opposite face 23 of the front box half 8. A volute 27 communicating with an outlet flange 28 is placed on the radially external perimeter of box 7, at the diffuser 26 exit.

Figure 2A:
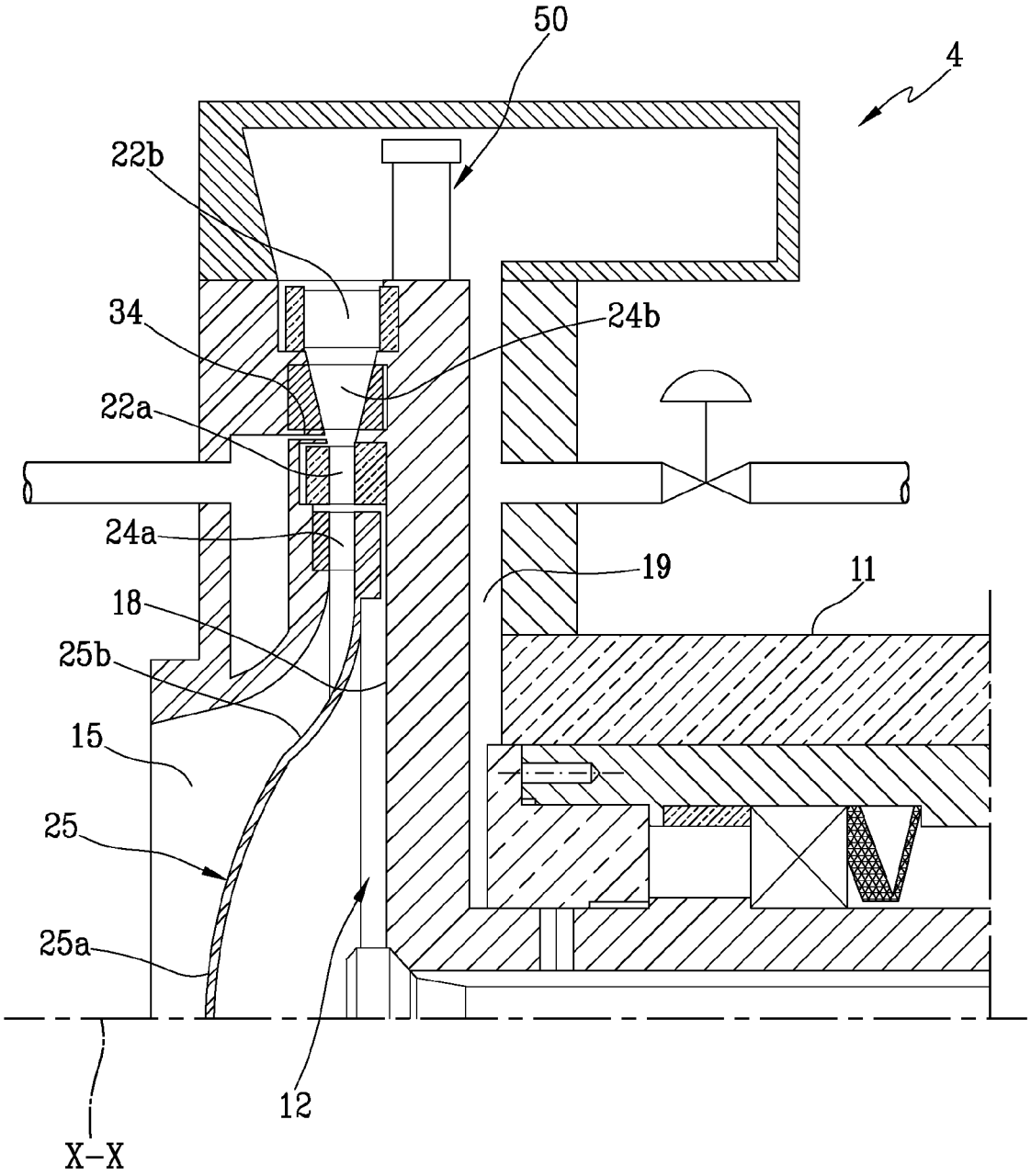
FIG. 2A is a different embodiment of the turbine of FIG. 2.

According to an alternative embodiment shown in FIG. 2A, in place of the third radial stage, the flow crosses an axial stage 50 fitted on the rotor perimeter.

The illustrated turbine 4 further comprises a compensation device for the axial thrust exerted by the working fluid on rotor 7 and, through shaft 13, on the thrust bearings 14. This device comprises a loading cell 29 axially interposed between sleeve 11 and the thrust bearing 14, a spring 30 adapted to keep the thrust bearing 14 pressed against the loading cell 29, a PLC (Programmable Logic Controller) (not shown) operatively connected to the loading cell 29 and an adjustment valve 31 positioned in a duct 32 in communication with the compensation chamber 21 and a further chamber 33 formed in the front box half 8 and brought to the same pressure as the working fluid at the exit from the first stage through passage holes 34. The device carries out feedback adjustment of the admission of working fluid from the further chamber 33 into the compensation chamber 21, as a function of the detected axial thrust, so as to keep the axial load on the bearing in a controlled condition.

Entry of the working fluid takes place from the axial inlet 15, at a position concentric with the front box half 8 that is smooth and of circular shape. As shown in FIG. 2, inside turbine 4 the fluid flow is deviated by baffle 25 and directed to the first series of stator blades 24*a* integral with baffle 25 and with the front box half 8.

The invention claimed is:

1. An ORC apparatus for generation of electric energy by organic Rankine cycle, comprising:

at least one heat exchanger (3) to exchange heat between a high temperature source and an organic working fluid, so as to heat and evaporate said working fluid until the working fluid reaches the vapour phase;

at least one expansion turbine (4) fed with the vaporised working fluid in the vapour phase coming out of the heat exchanger (3), to make a conversion of the thermal energy present in the vaporized working fluid in the vapour phase into mechanical energy according to a Rankine cycle;

an electric generator (5), the expansion turbine (4) being connected to the electric generator (5);

at least one condenser (6) where the working fluid outflowing from said at least one turbine (4) is condensed and sent to at least one pump (2); the fluid is then fed to said at least one heat exchanger (3);

wherein the expansion turbine (4) is in part of the radial-outflow type and comprises: one rotor disc (17) rotating about a rotation axis (X-X), at least one first series of rotor blades (22*a*) mounted on a front face (18) of the rotor disc (17) and disposed around the rotation axis (X-X) and at least one first series of stator blades (24*a*) mounted on the box (7), facing the rotor disc (17) and disposed around the rotation axis (X-X), said at least one first series of rotor blades (22*a*) and said at least one first series of stator blades (24*a*) being radial stages of the turbine (4);

wherein the turbine (4) further comprises at least one axial stage fitted on a radially external perimeter of the rotor disc (17).

2. An apparatus as claimed in claim 1, wherein the expansion turbine (4) comprises at least one second series of rotor blades (22*b*, 22*c*) disposed at a position radially external to the first series of rotor blades (22*a*) and at least one second series of stator blades (24*b*, 24*c*) disposed at a position radially external to the first series of stator blades (24*a*).

3. An apparatus as claimed in claim 1, wherein the expansion turbine (4) comprises a baffle (25) fixedly mounted on the box (7) at the axial inlet (15) and adapted to radially deviate the axial flow towards the first series of stator blades (24*a*).

4. An apparatus as claimed in the claim 3, wherein the baffle (25) has a convex surface (25*a*).

5. An apparatus as claimed in claim 3, wherein the baffle (25) carries the first series of stator blades (24*a*) at a radially peripheral portion thereof.

6. An apparatus as claimed in claim 1, wherein the front face (18) of the rotor disc (17) and the face (23) of the box (7) carrying the stator blades (24*a*, 24*b*, 24*c*) diverge from each other on moving away from the rotation axis (X-X).

7. An apparatus as claimed in claim 1, wherein the expansion turbine (4) comprises a diffuser (27) placed at a position radially external to the stator blades (24*a*, 24*b*, 24*c*) and rotor blades (22*a*, 22*b*, 22*c*).

8. An ORC process for generation of electric energy by organic Rankine cycle, comprising:

i) feeding an organic working fluid through at least one heat exchanger (3) to exchange heat between a high temperature source and said working fluid, so as to heat and evaporate said working fluid until the working fluid has reached the vapour phase;

ii) feeding the vaporised organic working fluid in the vapour phase outflowing from the heat exchanger (3) to at least one expansion turbine (4) connected to an electric generator (5), to make a conversion of the thermal energy present in the vaporized working fluid in the vapour phase into mechanical energy according to a Rankine cycle and then into electric energy through the generator (5);

iii) feeding the organic working fluid outflowing from said at least one expansion turbine (4) to at least one condenser (6) where the working fluid is condensed;

iv) sending the organic working fluid outflowing from the condenser (6) to said at least one heat exchanger (3);

wherein in step ii) the expansion turbine (4) is in part a radial-outflow turbine and the way followed by the working fluid from an inlet (15) to an outlet (16) of the expansion turbine is first a radial-outflow way and then the working fluid crosses an axial stage fitted on a perimeter of a rotor disc (17) of the turbine (4).

9. A process as claimed in claim 8, wherein the organic working fluid is selected from the group consisting of perfluoro-2-methylpentane, perfluoro 1,3 dimethylcyclohexane, hexamethyldisiloxane and octamethyltrisiloxane.

10. A process as claimed in claim 8, wherein the organic working fluid is selected from the group consisting of hydrocarbons, ketones, siloxanes, and fluorinated materials.

11. A process as claimed in claim 8, wherein the organic working fluid has a molecular weight included between 150 and 500 g/mol.

* * * * *